US005581894A

United States Patent [19]

Scharf

[11] Patent Number: 5,581,894

[45] Date of Patent: Dec. 10, 1996

[54] CARPET STRIP CUTTER ASSEMBLY

[76] Inventor: Gary Scharf, 9825 Carrol Center Rd., #200, San Diego, Calif. 92126

[21] Appl. No.: 562,886

[22] Filed: Nov. 27, 1995

[51] Int. Cl.[6] ..... B26B 29/06

[52] U.S. Cl. ..... 30/293; 30/294; 33/42

[58] Field of Search ..... 30/286, 289, 290, 30/292, 293, 294; 33/32.1, 32.3, 32.7, 41.6, 42, 527; 83/468.7

[56] References Cited

U.S. PATENT DOCUMENTS

| | | | |
|---|---|---|---|
| 4,095,341 | 6/1978 | Crain | 30/293 |
| 4,148,142 | 4/1979 | Sullivan et al. | 30/294 |
| 4,606,124 | 8/1986 | Figueroa | 30/293 |
| 5,353,508 | 10/1994 | Baker | 33/42 |

*Primary Examiner*—Hwei-Siu Payer
*Attorney, Agent, or Firm*—Charles C. Logan, II

[57] ABSTRACT

A carpet strip cutter assembly having an elongated base plate, a vertically oriented elongated left side wall connected to the base plate, and an elongated cantilevered support arm perpendicularly oriented to the left side wall. The cantilevered support arm is reciprocally mounted in the left side wall. A blade mounting assembly is secured to the front end of the cantilevered support arm and it has a blade extending downwardly therefrom. The blade is oriented above a line of grooves in the top surface of the base plate and removably received in one of the grooves. There is structure for vertically adjusting the height of the cantilevered support arm so that various heights of carpet can be cut into strips of carpet having predetermined widths.

13 Claims, 1 Drawing Sheet

CARPET STRIP CUTTER ASSEMBLY

BACKGROUND OF THE INVENTION

The invention relates to a cutting device and more specifically to a carpet strip cutter assembly for cutting strips of carpet for border work, carpet base, and feature strips.

It is very important in cutting strips of carpet that they be exactly the same width throughout their entire length. Present devices on the market have not been effective in controlling the width of the strips and often vary ½ inch or more along their length.

The Sullivan et al U.S. Pat. No. 4,148,142 is directed to a carpet cutting tool that captures the carpet between two opposed leg portions. The surface of the web that connects the two leg portions has a concave curvature that causes the carpet to ride up and down along this surface thereby changing the width of the strip that is being cut. Also the distance between the top and bottom leg members cannot be varied when different heights of carpet are being cut.

The Bowman U.S. Pat. No. 4,620,368 is directed to a carpet cutting tool that is pushed across the floor surface with a long handle. It has two plates that have a recess between them for mounting a blade. The handle is pivotally attached to one end of the assembled tube plate structure.

The Baughman U.S. Pat. No. 4,817,290 is directed to a carpet cutting tool. It has a triangular base and a trimming blade adjustably secured thereto. A handle is attached to the top of the base.

The Baker U.S. Pat. No. 5,353,508 is directed to a border cutter for use with a cutter blade carrier for cutting a strip of carpet. Spaced guides extend parallel to the blade opening, with each side having a plurality of slots extending there along in alignment with the slots of the other guide, providing a plurality of locations on the surface plate for the blade carrier.

It is an object of the invention to provide a novel carpet strip cutter assembly that will consistently cut strips of carpet that are equal in width along their entire surface.

It is another object of the invention to provide a novel carpet strip cutter assembly that has a perpendicular left side wall against which the edge of the carpet can travel without having a tendency to ride upwardly and downwardly on the vertical wall surface.

It is also an object of the invention to provide a novel carpet strip cutter assembly that has a removable base plate that can be replaced after abrasion from the bottom surface of the carpets being cut has seriously eroded the top surface.

It is a further object of the invention to provide a novel carpet strip cutter assembly that has a cantilevered support arm that can be raised and lowered to accept carpets having different heights.

It is an additional object of provide a novel carpet strip cutter assembly that has grooves in the top surface of the base plate for receiving the cutting blade and they eliminate wobble of the cutting blade during its cutting action.

SUMMARY OF THE INVENTION

The novel carpet strip cutter assembly has an elongated base plate. A plurality of grooves are formed in the top surface of the base plate and they each have a longitudinal axis that is parallel to the axis of the base plate itself. The grooves are oriented in a line that extends across the width of the base plate. The grooves are laterally spaced at predetermined intervals so that different widths of strips of carpet can be cut. The width of the grooves is only slightly greater than the width of the blade and this prevents blade flex during the cutting operation. The base plate is preferably made of aluminum material although other materials can be used.

A carpet edge left side vertical wall is removably attached to the top surface of the base plate. This allows the base plate to be replaced when there has been excessive abrasive wear on its top surface by the carpet passing thereover. The inner surface of the vertical wall is perpendicular to the top surface of the base plate to provide a good positive surface against which the left edge of the carpet can be pressed. A channel is formed in the top surface of the left side vertical wall and it is oriented perpendicular to the longitudinal axis of the base plate. A tubular cantilevered support arm is reciprocally mounted in this channel.

A blade mounting assembly is secured to the front end of the cantilevered support arm. It has a blade extending downwardly from its bottom surface. The cantilevered support arm can be moved inwardly and outwardly in the channel to vary which groove the blade will have its bottom edge inserted into depending upon what width a strip of carpet is to be cut. The structure of the blade mounting assembly allows the blade to be quickly changed when necessary without having to adjust the position of the cantilevered arm. The blades used have rounded corners which give greater strength to the blade and allow a greater amount of the cutting edge to be captured in the grooves on the top surface of the base plate. By adding or removing shims in the channel in the left side vertical wall, the height of the cantilevered support arm can be varied when carpets of different heights are being cut into strips.

DESCRIPTION OF THE PREFERRED EMBODIMENT

Figure 1:
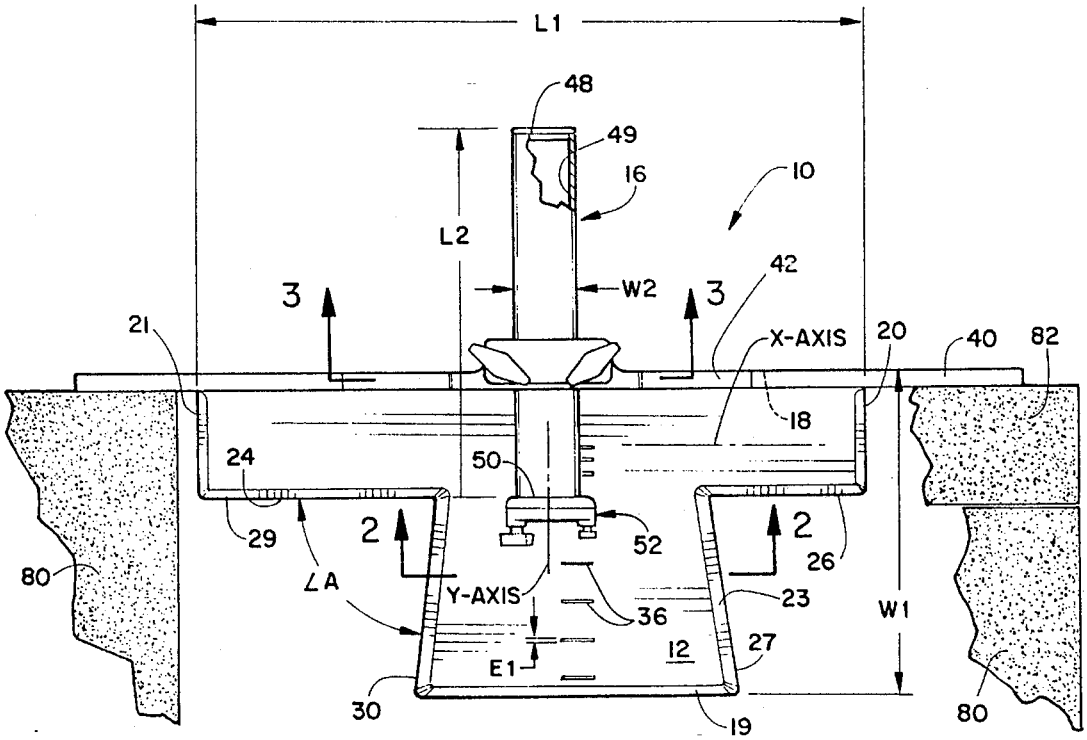
FIG. 1 is a top plan view of the carpet strip cutter assembly.
Figure 2:
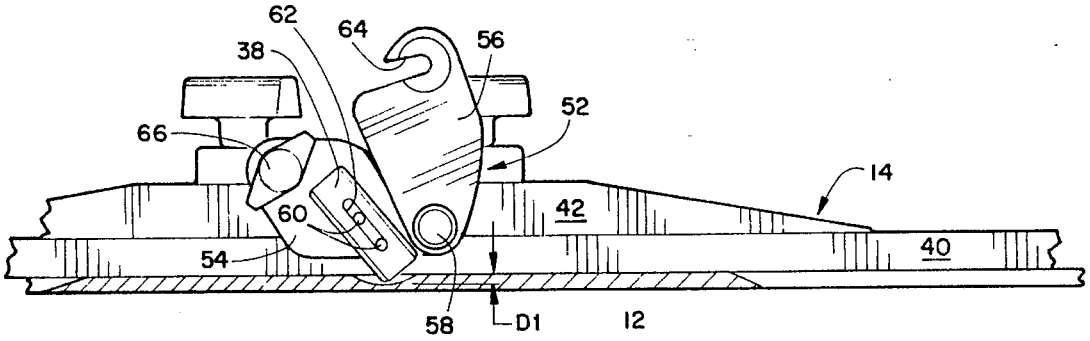
FIG. 2 is a cross sectional view taken along lines 2—2 of FIG. 1.
Figure 3:
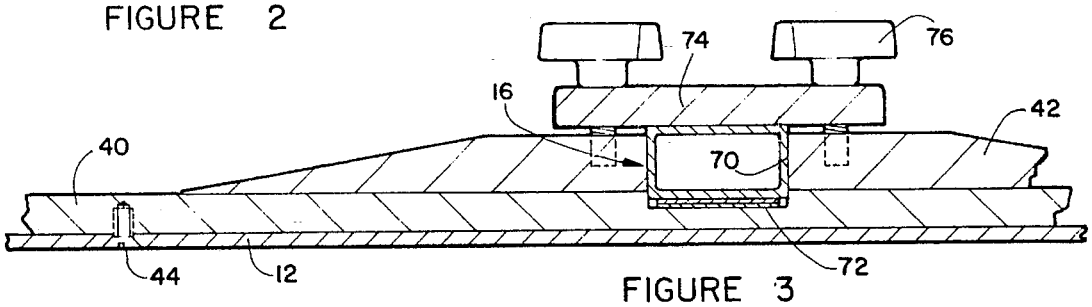
FIG. 3 is a cross sectional view taken along lines 3—3 of FIG. 1.

The novel carpet strip cutter assembly will now be described by referring to FIGS. 1–3 of the drawing. The carpet strip cutter assembly is generally designated numeral 10. It has a base plate 12, a carpet edge left side vertical wall 14 and a tubular cantilevered support arm 16.

Base plate 12 has a longitudinal X-axis, a left edge 18, a right edge 19, a front edge 20 and a rear edge 21. Cut-away portions 23 and 24 give base plate 12 a T-shaped configuration when viewed from its right edge. Edges 26 and 27 form cut-away portion 23. Edges 29 and 30 form cut-away portion 24. These respective edges intersect each other at acute angle A.

Base plate 12 has a substantially planar top surface and a substantially planar bottom surface. It has a length L1 that is in the range of 20–60 inches. It has a width W1 that is in the range of 8 to 24 inches.

A plurality of grooves 36 are formed in the top surface of base plate 12 and they each have a longitudinal axis that is parallel to the X-axis of base plate 12. Grooves 36 are oriented in aline that extends across the width of base plate 12. They are laterally spaced at predetermined intervals so that different widths of strips of carpet can be cut. Grooves 36 have a depth D1 that is in the range of 0.050–0.300 inches and a width E1 that is only slightly wider than the width of blade 38 which is 0.018 inch. E1 is in the range of 0.018–028 inches. Base plate 12 is preferably made of aluminum material.

Carpet edge left side vertical wall 14 has a lower portion 40 and an upper portion 42. Lower portion 40 is secured to the top surface of base plate 12 by screws 44.

Tubular cantilevered support arm 16 has a removable rear end cap 48 that provides access to a storage chamber 49. Cantilevered support arm 16 has a Y-axis and a length L2 in the range of 8 to 32 inches and a width W2. Front end 50 has a blade mounting assembly 52 secured thereto.

Blade mounting assembly 52 has a stationary plate 54 and a latch plate 56 that is pivotally mounted on pivot pin 58. A pair of pins 60 extend transversely from stationary plate 54 and align with slot 62 in blade 38. Blade 38 has rounded corners which allow it to sit much deeper in grooves 36. Latch plate 56 has a slot 64 that pivots down over the shank of tightening screw 66.

A channel 70 is formed in the top surface of upper portion 42 and extends downwardly into the lower portion 40. Shims 72 may be added or removed from the bottom surface of channel 70 to vary the height of cantilevered support arm 16 when carpet having different heights is cut into strips. Pressure plate 74 rigidly secures cantilever support arm 16 at any desired point along its Y-axis by tightening screws 76.

A roll of carpet 80 is cut into strips 82 by pulling carpet strip cutter assembly 10 toward the front edge of the sheet of carpet. The carpet travels over the top surface of base plate 12 and beneath cantilevered support arm 16. Blade 38 will have been inserted into the proper groove 36 for whatever width strip 82 is to be cut. The left edge of the sheet of carpet 80 hugs the perpendicular wall surface of vertical wall 14 to maintain a constant width for the strip 82 being cut.

What is claimed is:

1. A carpet strip cutter assembly comprising:

an elongated base plate having a longitudinal X-axis, a top surface, a bottom surface, a front edge, a rear edge, a left edge, a right edge, a length (L1) and a width (W1); a plurality of grooves each having a longitudinal axis that is parallel to said X-axis; said grooves being oriented in a line that extends across the width of said base plate; said grooves being laterally spaced at predetermined intervals so that different widths of strips of carpet can be cut; said grooves having a depth (D1) and a width (E1);

a vertically oriented left side wall connected to said base plate; said left side wall having an inner surface against which an edge of a carpet to be cut into strips rides;

an elongated cantilevered support arm having a longitudinal Y-axis; said Y-axis being oriented perpendicular to said X-axis; said cantilevered support arm having a front end, a rear end, a length (L2) and a width (W2);

a blade mounting assembly secured to the front end of said cantilevered support arm; said blade mounting assembly having a bottom surface and having part of a blade extending downwardly therefrom; said blade being oriented above said line of groove in the top surface of said base plate and removably received in one of said grooves; and means for reciprocally mounting said cantilevered support arm on said carpet cutter assembly so that said blade can be shifted laterally to any of said respective grooves in the top surface of said base plate.

2. A carpet cutter assembly as recited in claim 1 further comprising means for vertically adjusting the height of said cantilevered support arm so that various heights of carpet can be cut into strips of carpet having predetermined widths.

3. A carpet strip cutter assembly as recited in claim 2 wherein said means for reciprocally mounting said cantilevered support arm is a transversely extending channel in said left side wall whose width is slightly larger than (W2).

4. A carpet strip cutter assembly as recited in claim 3 wherein said means for vertically adjusting the height of said cantilevered support arm are individual shim members that are removably positioned in said channel beneath said cantilevered support arm.

5. A carpet strip cutter assembly as recited in claim 1 further comprising means for locking said cantilevered support arm at predetermined reciprocal positions with respect to said base plate.

6. A carpet strip cutter assembly as recited in claim 1 wherein said base plate has a T-shaped configuration when viewed from its right edge.

7. A carpet strip cutter assembly as recited in claim 1 wherein said base plate is made of aluminum material.

8. A carpet strip cutter assembly as recited in claim 1 wherein said cantilevered arm is tubular and it has a storage chamber in its interior and a removable end cap.

9. A carpet strip cutter assembly as recited in claim 1 wherein said grooves have a width (E1) that is only slightly greater than the width of said blade.

10. A carpet strip cutter assembly as recited in claim 1 wherein (L1) is in the range of 20–60 inches.

11. A carpet strip cutter assembly as recited in claim 1 wherein (W1) is in the range of 8–24 inches.

12. A carpet strip cutter assembly as recited in claim 1 wherein (D1) is in the range of 0.050–0.300 inches.

13. A carpet strip cutter assembly as recited in claim 1 wherein (L2) is in the range of 8–32 inches.

* * * * *